United States Patent [19]

Cabianca

[11] Patent Number: 4,858,926

[45] Date of Patent: Aug. 22, 1989

[54] STICK FOR THE BILLIARD GAME

[76] Inventor: Walter Cabianca, Via IV Novembre 2, Cornedo Vicentio (Vicenza), Italy

[21] Appl. No.: 175,903

[22] Filed: Mar. 31, 1988

[30] Foreign Application Priority Data

Apr. 8, 1987 [IT] Italy ..... 85533 A/87

[51] Int. Cl.[4] ..... A63D 15/08

[52] U.S. Cl. ..... 273/68; 273/70; 403/297; 403/286; 403/109

[58] Field of Search ..... 273/68–70, 273/300; 403/104, 109, 371, 290, 297, 286; 280/823

[56] References Cited

U.S. PATENT DOCUMENTS 861,158 7/1907 Bucknam ..... 273/68
1,252,632 1/1918 Voje ..... 273/68
2,446,406 8/1948 Beyerle ..... 403/286
4,238,164 12/1980 Mazzolla ..... 403/104
4,718,671 1/1988 Desmond et al. ..... 273/68

FOREIGN PATENT DOCUMENTS 405110 2/1934 United Kingdom ..... 403/297

*Primary Examiner*—Edward M. Coven
*Assistant Examiner*—Mark S. Graham
*Attorney, Agent, or Firm*—Bucknam and Archer

[57] ABSTRACT

A stick for the billiard game comprises a central body (1), cue tip (2) connected to it, the cue tip having head (3), and hand grip (4) in the rear portion. The central body (1) is capable of being lengthened due to a staff (5) which may be adjusted in length. The hand grip is disassemblable and the head is replaceable.

6 Claims, 3 Drawing Sheets

STICK FOR THE BILLIARD GAME

The present invention relates to a stick of metallic material for the billiard game and more specifically, it relates to a stick which may be lengthened depending upon the requirements of the player and with the cue tip dismountable by means a rapid and secure coupling.

It is known that a billiard player, particularly in important contests, must have available several sticks of different length and different properties in order to adapt himself to different conditions of hitting the ball and depending upon the location of the ball on the plane of the table and the different directions of hitting the ball depending upon the stage of the game.

The stick according to the present invention is intended to avoid all these inconveniences because it exhibits variable length within a substantial range and also offers the possibility of substituting easily the cue tip depending upon the requirements of the game.

An essential feature of the invention resides in the fact that the lengthening of the stick is obtained by acting on the rear section of the stick which is behind the conventional position of gripping the stick. In fact, the rear hand grip of the stick is screwed on a tubular staff which may slide within the tubular central body of the stick fixed to the same corresponding to the desired position of length simply by rotating the hand grip through a reduced angle of about 90°.

Another feature of the stick according to the invention resides in the fact that the main staff is divided in two parts which are connected with a coupling by means of a screw of a particular type which permits the two parts to be screwed simply by reciprocal rotation of 90°.

Another feature of the present invention resides in the fact that the head of the cue tip is connected by screwing and is blocked in position by a tubular segment of expandable rubber so that it may be easily replaced, for instance, in case the tip has been worn out or simply when the head used in training is replaced by the head used during the actual game.

The features described hereinabove and possible variations are illustrated in the accompanying drawings of which:

Figure 1:
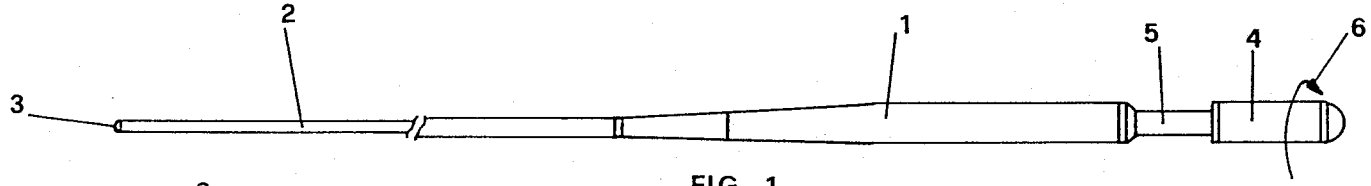
FIG. 1 is the view of the entire stick in the lengthened position.
Figure 2:
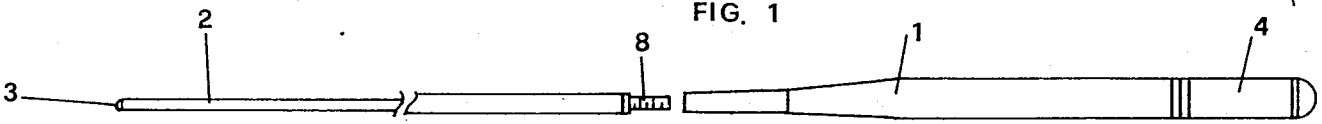
FIG. 2 illustrates the same stick after it has been disassembled in the two component parts.
Figure 3:
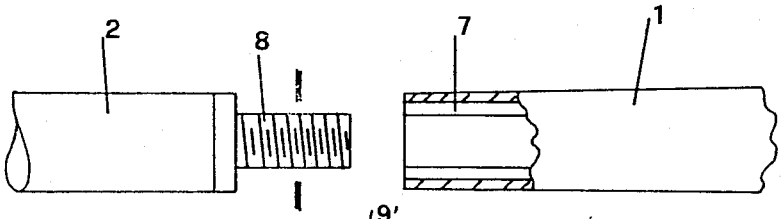
FIG. 3 is a side view of the section of the connection by means of an intermediate screw.
Figure 5:
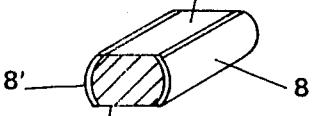
FIG. 5 illustrates the section of the screw having two opposite, threaded, circular segments.

As shown in FIG. 1, the stick comprises a central body 1 to which is screwed the cue tip 2 provided with head 3. The central body 1 is lengthened in hand grip 4 which is provided with staff 5, the latter being inserted in the central body 1. In this manner staff 5 is fixed in the desired position by means of a simple step of rotation of about a quarter of a revolution of the hand grip 4 in the direction shown by arrow 6. FIG. 2 shows the hand grip 4 in contact with the central body 1 so that the stick is in a position corresponding to the shortened length. FIG. 3 shows the central body 1 provided with threads 7, the threads engaging with the external threads 8 of the screw 9 which is shown in FIG. 5, the screw emerging from the head of the cue tip 2. According to one embodiment of the stick of the invention, the possibility exists that the intermediate section 1 of the stick is provided with an emerging threaded section, while the cue tip 2 is hollow in the rear portion of the head in order to receive the threaded portion of the central body 1 so as to reverse the arrangement illustrated in FIG. 3.

FIG. 5 shows that the transversal section of the emerging portion 9 has two planar and parallel surfaces on the side of which two curved surfaces are provided which have the necessary threading to couple with the central body 1.

Figure 4:
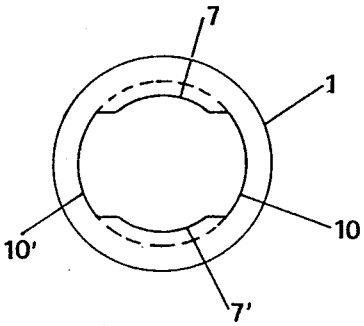
FIG. 4 is a front view on an enlarged scale of one of the two parts of the stick.

As shown in FIG. 4 the central body 1 has two threaded opposite sections, 7 and 7', separated by two smooth sections, 10 and 10', so that the connection between the cue tip 2 and the central body 1 of the stick is ensured simply by inserting the threaded end 8 in the opening provided in the interior of the central body 1 and by a rotation of about 90°. In this manner the threaded sections, 8 and 8', of the stem 9 engage with the threaded sections 7 and 7' of the opening formed in the end of the central body 1.

Figure 6:
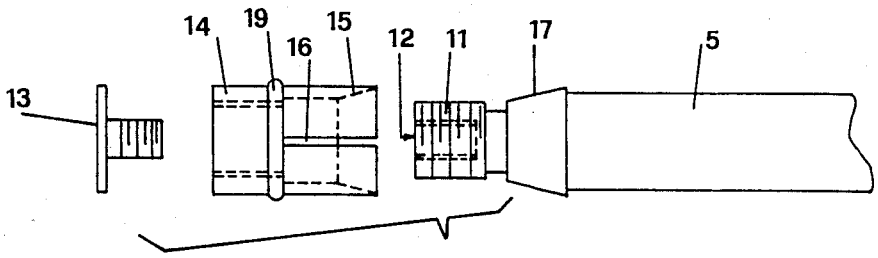
FIG. 6 is a side view of the section of the expandable sleeve intended to rapidly fix the portion of the stick which may be lengthened.
Figure 7:
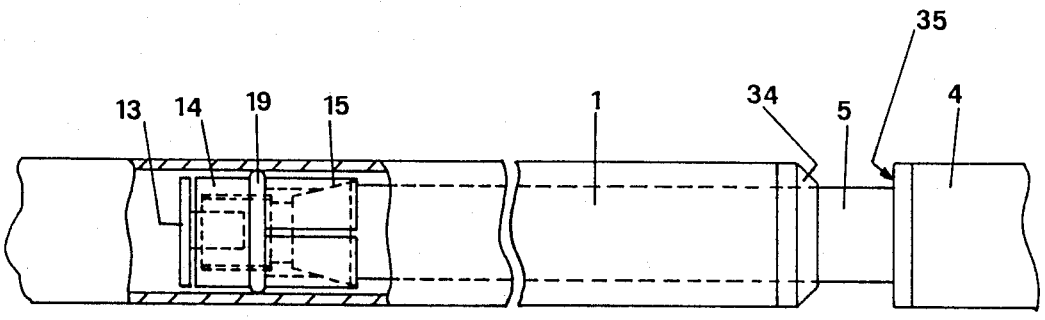
FIG. 7 illustrates the same section partially in cross-section after it has been inserted in the tubular element in the phase preceding the blocking phase.
Figure 8:
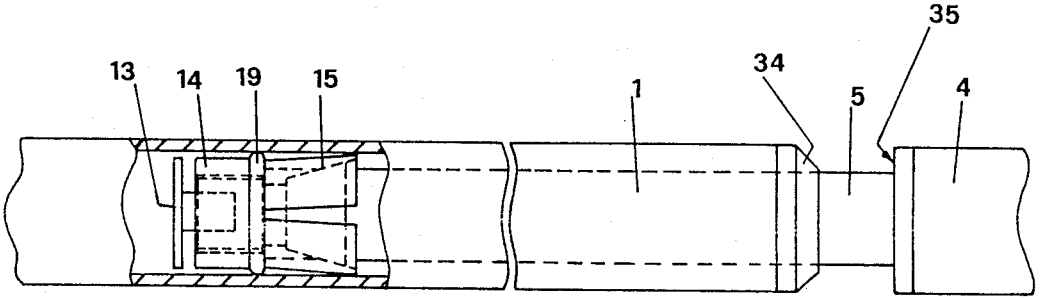
FIG. 8 illustrates the same after the rotation of the hand grip in a blocking position.

FIGS. 6, 7 and 8 illustrate the first embodiment of coupling of the staff 5 of the hand grip 4 with the central body 1 of the stick. Specifically, the staff 5 has a threaded end section 11 which has a head provided with a threaded opening 12 within which the stem of screw 13 is engaged after insertion of sleeve 14. The latter is provided with an inner trunco-conical section 15 and with longitudinal notches 16 which give elasticity to the rear portion of sleeve 14. The inner trunco-conical surfaces 15 rest against the trunco-conical section 17 formed in the end section of staff 5 immediately behind the threaded section 11.

The stem of the stick 13 is tightly screwed within the opening 12 and the purpose is to prevent the complete unscrewing of the section 11 from the sleeve 14.

FIGS. 7 and 8 show that an annular channel is formed along the external surface of the sleeve 14 within which an elastic ring 19 made of rubber is inserted. This ring being in contact with the internal surface of the central body 1, prevents the rotation of the sleeve 14 while at the same time permitting the advance or the displacement rearwardly along the central body 1 in order to allow the staff 5 to be removed with the related hand grip 4, depending upon the requirements of the game.

For the purpose of preventing the rotation of the sleeve 14, there is provided a key which is placed in the front part of the sleeve, the key being intended to engage in the interior of a longitudinal groove made along the central body 1. After determining the optimum position of the staff 5 with respect to the central body 1, it is sufficient to cause rotation of the hand grip 4 along an angle of about 90°, clockwise while keeping the central body 1 still with the other hand so that the groove 16 of sleeve 14 is enlarged.

Figure 9:
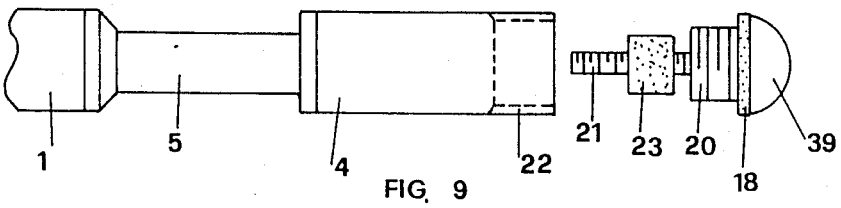
FIG. 9 illustrates the hand grip of the stick with the rear portion disassembled.

FIG. 9 shows the rear part of the hand grip 4 which is dismountable and is provided with a knurled disc 18, the latter being provided with a rubber bumper 39. The disk 18 is provided with two threaded segments 20 and 21 of different diameter. The first segment engages with the corresponding threaded segment 22 formed internally in the hand grip 4 while the latter offers a seat for the disposal of a plurality of weights 23, which being fixed onto the threaded staff 21 permit variation of the weight of the stick.

It is obvious that the player when he desired to calibrate the stick must only unscrew disc 18 and then act on the weights 23 which rotate on the threaded pin 21, and he will substitute or eliminate weights with a simple and effective maneuver.

Advantageously, the weights 23 may be substituted by different weights or may be eliminated depending upon the requirements of the player.

Figure 11:
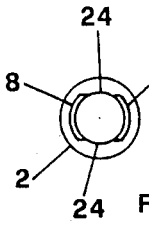
FIG. 11 is a front view of the screw.
Figure 10:
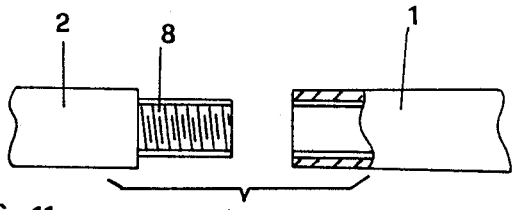
FIG. 10 is a side view partially in cross-section of the two parts of the stick prior to screwing them together.
Figure 12:
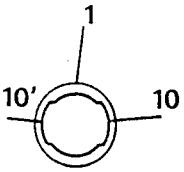
FIG. 12 is a front view of the threaded cavity.

FIGS. 10, 11 and 12 show a variation of the coupling by means of a screw between the two parts of the cue tip shown in FIGS. 3, 4 and 5. FIGS. 10, 11 and 12 show that the threaded portions, 8 and 8', which emerge from the tip 2 are followed by curved portions 24 and 24' which emerge from the cue tip 2 rather than being followed by planar sections as shown in FIG. 5. The purpose is to keep the surfaces 24 and 24' adhering to the surfaces 10 and 10' of the hollow stem 1 which are not threaded, as shown in FIG. 12.

Figure 13:
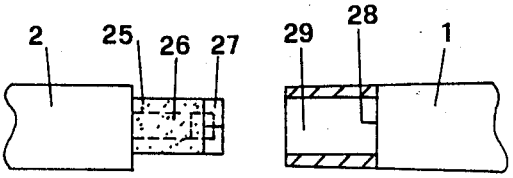
FIG. 13 is a side view of a second embodiment of the screw coupling with a sleeve for blocking made of expandable rubber with the two parts separated one from the other.
Figure 14:
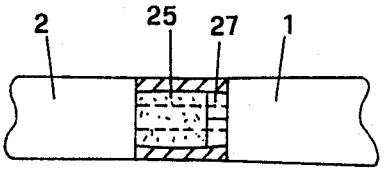
FIG. 14 illustrates the same coupling with the two parts connected one to the other.

Still according to another embodiment of the invention, the coupling between the central body 1 and the cue tip 2 of the stick as shown in FIG. 13 is achieved by means of a sleeve 25 made of expandable rubber which is inserted along the threaded section 26, which section emerges from the end of the cue tip 2. A metallic nut 27 is screwed on the end of the threaded section 26, this nut being inserted to make contact with the internal wall 28 of the cylinder cavity 29, formed in the end of the central body 1. This nut stops against the cylindrical cavity 29 and compels the elastic sleeve 25 to expand so that it adheres to the internal walls of the cavity 29 as shown in FIG. 14, and in this manner makes sure that the two parts being connected are held firmly one to the other.

Figure 15:
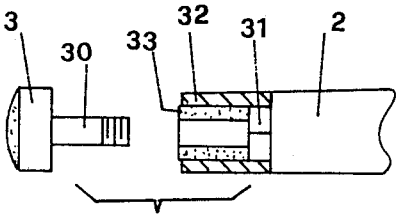
FIG. 15 is a side view partially in cross section of the end of the head of the cue tip in the disassembled position.
Figure 16:
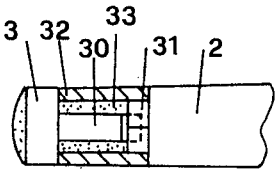
FIG. 16 illustrates the same in the assembled position.

FIGS. 15 and 16 show that the head 3 provided with partially threaded stem 30 is screwed on the nut 31, inserted in the interior of the cavity 32, which is provided with sleeve 33. The latter is formed at the end of the cue tip 2 of the stick. In this manner the sleeve 33 is compressed when the stem 30 is screwed on nut 31, and in this manner the head 3 of the cue tip 2 is blocked as shown in FIG. 16.

According to another embodiment of the invention, the lengthening of the stick may be obtained in the front portion of the stick rather than in the rear portion by using the identical type of devices and with suitable adaptation of the individual components. Naturally all the details of the invention shown in the figures have been given by way of example, but the different components may assume different shape while keeping the essential features of the invention constant.

What is claimed is:

1. A billiard stick which comprises a central body (1), said central body having a forward end and a rear end, a cue tip (2) having a forward end and a rear end, said cue tip (2) connected to said central body at the forward end thereof, said cue tip (2) having a head (3) at the forward end thereof, said central body being telescopically adjustable in length, a hand grip (4) at the rear end of said central body, means for adjusting the length of said central body comprising a staff (5) having a forward end and a rear end, said staff (5) connected to said hand grip (4), said staff having an externally threaded portion (11) at the forward end thereof, said staff (5) being blocked within said central body (1) by means of a threaded sleeve (14), said sleeve being internally threaded to engage with the externally threaded portion (11) of said staff and having longitudinal grooves (16), in the rear portion thereof, said longitudinal grooves dividing said sleeve into sectors, said staff (5) having an inner trunco-conical portion (17) in the forward end thereof, said sleeve having an inner trunco-conical section (15), a rubber ring means (19) located around said sleeve, said ring means preventing the rotation of said sleeve when said staff is inserted in said central body, said staff (5) has a threaded orifice (12) in the forward end thereof, and a nut (13) for engagement with said threaded orifice, said staff being fixed in a set position when said hand grip is rotated of about 90°, said inner trunco-conical surface (15) of said sleeve rests against said trunco-conical section (17) of said staff and said nut engages with said threaded orifice.

2. The stick according to claim 1 wherein said cue tip is connected to said central body (1) by means of a coupling having a screw comprising two threaded portions (8) and (8') opposite one to the other, said threaded portions being separated by two planar portions (9) and (9') opposite one to the other, whereby the rear end of said cue tip (2) is blocked against the central body (1) when rotated about a quarter of a revolution.

3. The stick according to claim 1 wherein said hand grip (4) has a forward end and a rear end and is disassemblable in the rear end thereof, has an internally threaded opening (22) and is provided with a knurled disc (18), said disc having two threaded pins (20) and (21), said threaded pin (20) engaging with the internally threaded opening (22), and a plurality of weights (23) which are fixed to said threaded pin (21) whereby the weight of the stick may be varied depending upon the requirements of the player.

4. The stick according to claim 1 wherein said central body (1) has a cylindrical cavity (29), and a nut (27) which is inserted within said cylindrical cavity, said cue tip (2 has a threaded stem (26) emerging therefrom, a sleeve made of expandable rubber (25) mounted on said threaded stem (26) said stem engaging said nut (27), whereby said central body (1) is connected to said cue tip (2), and whereby said sleeve (25) expands in the interior of said cavity (29) so that the connection between said central body (1) and said cue tip (2) is firm.

5. The stick according to claim 4 wherein the head (3) of said cue tip is provided with a stem (30), said stem being partially threaded, said stem engaging a nut (31), said nut being located within a cylindrical cavity (32) formed in the forward end of said cue tip, a sleeve (33) made of rubber is interposed between said cue tip and said head, said sleeve expanding when said stem (30) is screwed on said nut, whereby the forward end of said cue tip is blocked, and said head (3) is replaceable with a new head according to the requirements of the game.

6. The stick according to claim 1 wherein said central body (1) has a trunco-conical surface (34) at the rear end thereof, said hand grip has a forward portion, said forward portion of said hand grip (4) engaging with the trunco-conical portion of said central body when the stick is assembled.

* * * * *